US006264440B1

(12) United States Patent
Klein et al.

(10) Patent No.: US 6,264,440 B1
(45) Date of Patent: Jul. 24, 2001

(54) CENTRIFUGAL PUMP HAVING AN AXIAL THRUST BALANCING SYSTEM

(75) Inventors: Manfred P. Klein, Highland Park; Jeffrey S. Brown, Plainfield; Scott A. McAloon, Lombard; Peter E. Phelps, Darien, all of IL (US)

(73) Assignee: Innovative Mag-Drive, L.L.C., Chicago, IL (US)

( * ) Notice: Subject to any disclaimer, the term of this patent is extended or adjusted under 35 U.S.C. 154(b) by 0 days.

(21) Appl. No.: 09/428,731

(22) Filed: Oct. 28, 1999

Related U.S. Application Data

(60) Provisional application No. 60/106,103, filed on Oct. 29, 1998.

(51) Int. Cl.[7] ..... F04B 17/00

(52) U.S. Cl. ..... 417/420; 417/352; 417/365; 415/106

(58) Field of Search ..... 417/420, 362, 417/365, 356; 415/104, 106, 112

(56) References Cited

U.S. PATENT DOCUMENTS

| | | | | |
|---|---|---|---|---|
| 3,771,910 | * | 11/1973 | Laing | 417/420 |
| 6,095,770 | * | 8/2000 | Obata et al. | 417/420 |
| 6,135,728 | * | 10/2000 | Klein et al. | 417/420 |

* cited by examiner

*Primary Examiner*—Teresa Walberg
*Assistant Examiner*—Thor Campbell

(57) ABSTRACT

In accordance with a preferred embodiment of the invention, a centrifugal pump includes a housing having a housing cavity, an inlet, and an outlet. A shaft is located in the housing cavity. A radial bearing coaxially surrounds the shaft. The shaft and the radial bearing are rotatable with respect to one another. The impeller includes an impeller hub within an opening and an impeller recess for receiving the radial bearing. A thrust balancing valve is associated with the impeller hub to define a variable orifice for fluidic communication with the inlet. A wall for containing the pumped fluid has an interior surface with different elevations for inhibiting rotational flow and reducing angular velocity of the fluid. The interior surface is disposed adjacent to a rear portion of the impeller.

27 Claims, 13 Drawing Sheets

STATIC HEAD PROFILES ON IMPELLER

CENTRIFUGAL PUMP HAVING AN AXIAL THRUST BALANCING SYSTEM

This document claims the benefit of the filing date of U.S. Provisional Application No. 60/106,103, filed on Oct. 29, 1998, for the common subject matter disclosed in this document and the provisional application.

FIELD OF INVENTION

The present invention relates to a centrifugal pump having an axial thrust balancing system for balancing axial forces acting upon the impeller during operation of the pump.

BACKGROUND OF THE INVENTION

Centrifugal pumps include canned-motor centrifugal pumps and magnetic-drive centrifugal pumps. Magnetic-drive pumps are generally well-suited for pumping caustic and hazardous fluids because shaft seals are not required. Instead of shaft seals, magnetic-drive pumps generally feature a pump shaft separated from a drive shaft by a containment shell. The drive shaft is arranged to rotate with a first magnetic assembly, which is magnetically coupled to a second magnetic assembly. The second magnetic assembly applies torque to the pump shaft to pump a fluid contained by the containment shell.

An operational range of a hydraulic thrust balancing system within a pump may be limited to a critical operating point of low head and high flow. At a lower head or higher flow than the critical operating point, an inadequate static pressure differential within the pump may prevent the hydraulic thrust balancing system from maintaining an axially balanced position of the impeller. Instead, an axial bearing about an eye of the impeller may absorb axial thrust where inadequate static pressure is present for reliable operation of the thrust balancing system. However, the axial bearing can require routine maintenance, can heat the pumped fluid, and can add drag to the drive motor of the pump. Thus, a need exists for a pump with an extended operational range, for a thrust balancing system, over a complete desired range of head and capacity.

When changes in inlet flow of the fluid disrupt the axial position of the impeller from an axially balanced position, a thrust balancing system may respond too slowly or with an inadequate restoring force to avoid frictional contact between the members of the axial bearing before the impeller returns to an axially balanced position. Thus, a need exists for a thrust balancing system that provides a greater stiffness or a more responsive restoring force to avoid stress and undesired wear to an axial bearing.

SUMMARY OF THE INVENTION

In accordance with a preferred embodiment of the invention, a centrifugal pump includes a housing having a housing cavity, an inlet, and an outlet. A shaft is located in the housing cavity. A radial bearing coaxially surrounds the shaft. The shaft and the radial bearing are rotatable with respect to one another. The impeller includes an impeller hub within an opening and an impeller recess for receiving the radial bearing. A thrust balancing valve is associated with the impeller hub to define a variable orifice for fluidic communication with the inlet. A wall for containing the pumped fluid has an interior surface with different elevations for inhibiting rotational flow and reducing angular velocity of the fluid. The interior surface is disposed adjacent a rear portion of the impeller.

DETAILED DESCRIPTION OF THE PREFERRED EMBODIMENTS

Figure 1:
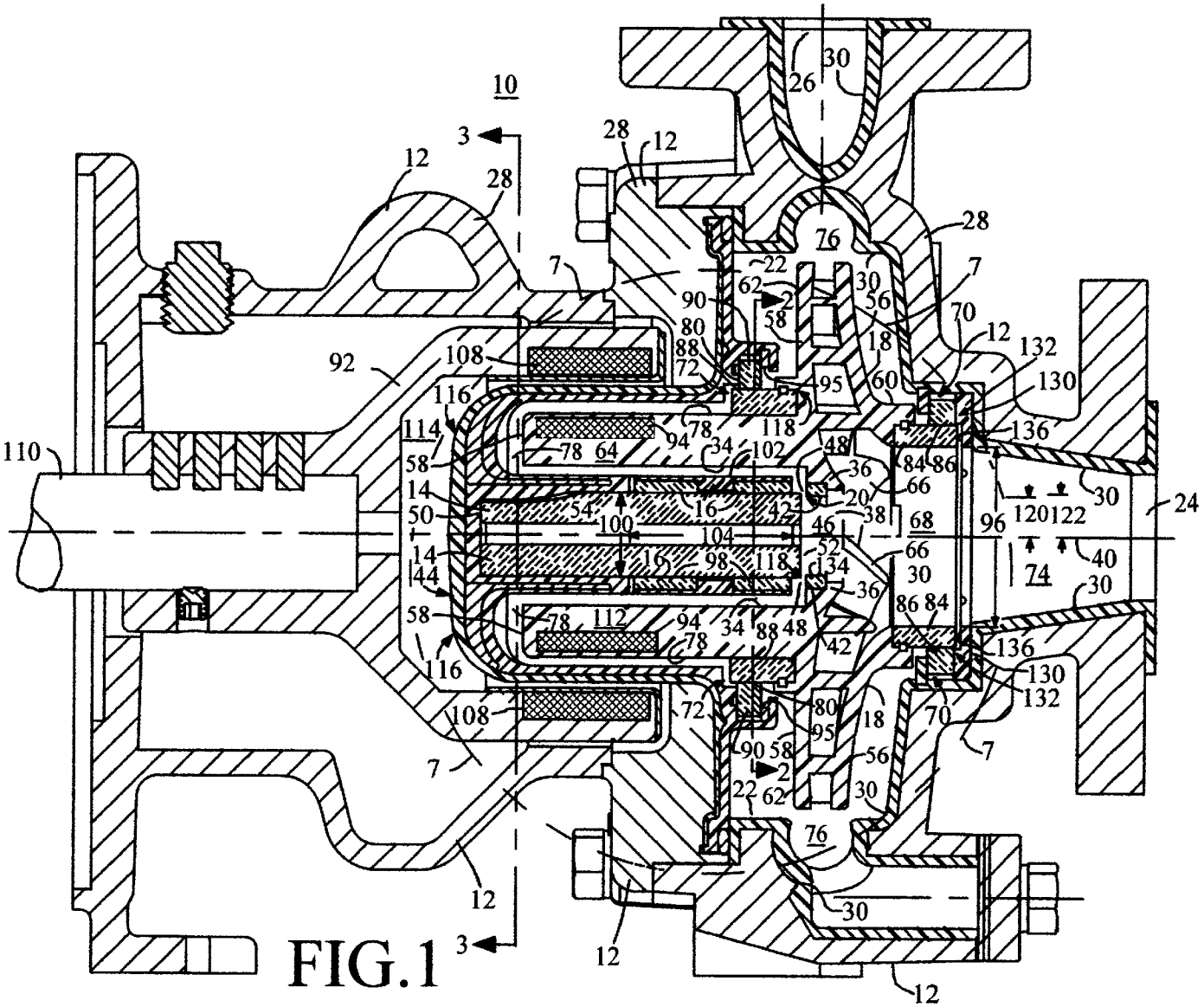
FIG. 1 is a cross-sectional view of a centrifugal magnetic-drive pump in accordance with the invention.

FIG. 1 illustrates a centrifugal pump 10 in accordance with the present invention. The centrifugal pump 10 includes a housing 12, a shaft 14, a radial bearing 16, an impeller 18, and a thrust balancing valve 20. The housing 12 has a housing cavity 22, an inlet 24, and an outlet 26. The housing 12 may be cast, molded, or otherwise formed by a group of housing sections 28 which can be attached to each other with fasteners. The housing cavity 22 is preferably lined with a corrosion-resistant material 30. A shaft 14 is located in the housing cavity 22. A radial bearing 16 coaxially surrounds the shaft 14. The shaft 14 and the radial bearing 16 are rotatable with respect to one another.

An impeller 18 is positioned to receive a fluid from the inlet 24 and to exhaust a fluid to the outlet 26 during rotation of the impeller 18. The impeller 18 has an impeller recess 34 terminating at an impeller hub 36 with an opening 38 in the impeller hub 36. The impeller recess 34 receives the radial bearing 16. The impeller hub 36 is preferably, generally axially located within the housing 12 such that a radial axis extending perpendicularly to a shaft axis 40 of the shaft 14 would bisect both the impeller hub 36 and the outlet 26 of the pump 10.

A thrust balancing valve 20 includes a ring 42 extending from or affixed to the impeller hub 36 and preferably spaced apart from a containment member 44. The ring 42 has an interior region 46 in fluidic communication with the opening 38. The ring 42 and the shaft 14 are adapted to define a thrust-balancing valve 20 having a variable orifice 48 between the ring 42 and the shaft 14. The variable orifice 48 adjusts to a vent size for regulating a flow of fluid through the variable orifice 48 to balance net axial forces acting upon the impeller 18 during operation of the pump 10. The thrust balancing valve 20 adjusts flow to hydraulically displace the impeller 18 to an axial position within a range of axial positions that minimizes any net axial force on the impeller 18.

The shaft 14 has a first end 50 and a second end 52. The first end 50 preferably mates with a socket 54 in a containment member 44 or is otherwise mechanically supported by the containment member 44. The second end 52 forms a boundary of the variable orifice 48 and a stop for rearward axial movement of the impeller 18. The first end 50 and the second end 52 may be planar or curved. The second end 52 is preferably planar and normal to the shaft axis 40. Alternately, the second end 52 may be rotationally symmetric (i.e. generally conical), with reference to the shaft axis 40, to act as one side of a thrust balancing valve.

The shaft 14 is preferably hollow and slidably removable from the containment member 44. The shaft 14 is hollow to reduce or eliminate the tendency of hydraulic forces to pull the shaft 14 out from the socket 54 in the containment member 44. In alternate embodiments, the shaft 14 is not hollow, but threaded, notched, molded, adhesively bonded, or otherwise mechanically attached to the containment member 44.

As shown in FIG. 1, the shaft 14 comprises a cantilevered shaft that advantageously leaves the inlet 24 available for mounting flow-enhancing equipment for pumping difficult fluids, liquids, gases, or mixtures of gases and fluids under difficult conditions, such as low or intermittently low pressures. The cantilevered shaft 14 with the unobstructed inlet 24 to the pump allows the best NPSH (Net Positive Suction Head) characteristics for feeding the pump so that gas prone to cavitation and low pressure fluids can successfully feed the pump.

The shaft 14 is preferably composed of a ceramic material or a ceramic composite. In an alternate embodiment, the shaft 14 is composed of a stainless steel alloy or another alloy with comparable or superior corrosion-resistance and structural properties. In another alternate embodiment, the shaft comprises a metal base coated with a ceramic coating or another hard surface treatment.

The impeller 18 preferably comprises a closed impeller, although in other embodiments open impellers or partially closed impellers may be used. The impeller 18 preferably includes a front side 56 facing an inlet 24 and a back side 58 opposite the front side 56. For a closed impeller 18 as shown in FIG. 1, the front side 56 may be a generally annular and curved surface terminating in a flange 60. The back side 58 may include a generally cylindrical portion 64 and a generally annular surface 62 extending radially outward from the cylindrical portion 64. The impeller 18 includes blades 66 for propelling a fluid from an eye 68 of the impeller 18 generally radially outward during rotation of the impeller 18.

A first wear ring assembly 70 is associated with the front side 56 and a second wear ring assembly 72 is associated with the back side 58 of the impeller 18. The first wear ring assembly 70 defines a boundary between a suction chamber 74 and a discharge chamber 76.

The second wear ring assembly 72 defines a boundary between a discharge chamber 76 and a balancing chamber 78. The second wear ring assembly 72 preferably provides hydrodynamic resistance to fluid at discharge pressure so that fluid traversing a gap 80 or labyrinth of the second wear ring from the discharge chamber 76 to the balancing chamber 78 is reduced in pressure to approximate or equal a balancing pressure suitable for balancing axial thrust acting upon the impeller 18.

Alternately, in another preferred embodiment, the second wear ring assembly 72 reduces the pressure to an intermediate pressure suitable for subsequent increases in pressure and pressure uniformity throughout the balancing chamber 78 by radial ribs 82 extending from the containment member 44. After the fluid at the intermediate pressure interacts with the radial ribs 82, a balancing pressure, in the balancing chamber 78, suitable for balancing axial thrust upon the impeller 18 is obtained. The balancing pressure is preferably within a range from approximately one-quarter of the total dynamic head (TDH) of the discharge chamber 76 to approximately one-third of the total dynamic head (TDH) of the discharge chamber 76.

The first wear ring assembly 70 preferably includes a first inner ring 84 affixed to the impeller 18 at a flange 60 and cooperating with a first outer ring 86. The first inner ring 84 rotates with the impeller 18, while the first outer ring 86 is generally stationary in the rotational direction of the first inner ring 84. The first inner ring 84 is preferably axially elongated to have a greater axial length than the first outer ring 86. The first wear ring assembly 70 allows operation of the impeller 18 within a range of potential axial positions of the impeller 18 relative to the housing 12. The first outer ring 86 is affixed to the housing cavity 22 or a thrust pad 130. The first outer ring 86 preferably has a maximum wearing surface area less than a wearing surface area of the first inner ring 84. While the first inner ring 84 is preferably axially longer than the first outer ring 86, in alternate embodiments the first inner ring and the first outer ring may have any relative axial lengths with respect to one another.

The second wear ring assembly 72 includes a second inner ring 88 affixed to or on the impeller 18 and a second outer ring 90 operably connected to a containment member 44 or the housing cavity 22. The second inner ring 88 rotates with the impeller 18, while the second outer ring 90 does not. The second inner ring 88 preferably has a greater axial length than the second outer ring 90. The second wear ring assembly 72 allows operation of the impeller 18 within a range of potential axial positions of the impeller 18 relative to the housing 12. The second outer ring 90 preferably has a maximum wearing surface area less than a wearing surface area of the second inner ring 88. While the second inner ring 88 is preferably axially longer than the second outer ring 90, in alternate embodiments the second inner ring and the first second ring may have any relative axial lengths with respect to one another.

The first wear ring assembly 70 preferably has a smaller inner diameter than the second wear ring assembly 72 does. In particular, a first generally circular area within the first inner ring 84 is less than or equal to approximately seventy percent of a second generally circular area within the second inner ring 88. The first generally circular area is bounded by an inner circumference of the first inner ring 84 of the first wear ring assembly 70. The second generally circular area is bounded by an inner circumference of the second inner ring 88 of the second wear ring assembly 72.

Figure 4:
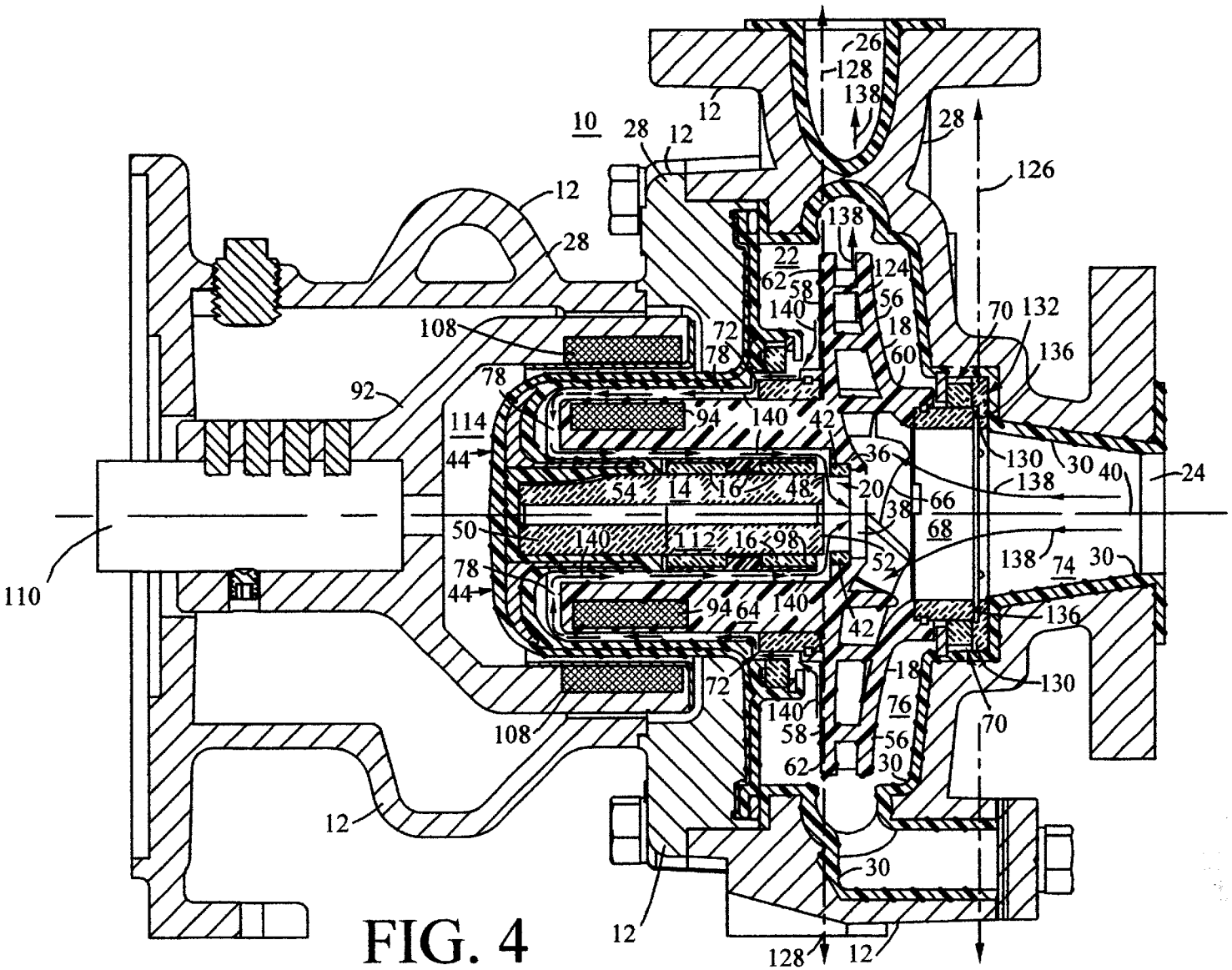
FIG. 4 is a cross-sectional view of a pump of FIG. 1 operating at an intermediate axial position within a range of potential axial positions of the impeller to balance axial forces on the impeller.

The first generally circular area is associated with a suction force acting upon the impeller 18, while the second generally circular area is associated with a reduced discharge force, called the balancing force, acting upon the impeller 18. The area ratio or percentage of the first generally circular area to the second generally circular area is selected such that the balancing valve 20 is capable of adjusting the balancing force to balance front-side impeller forces against the back-side impeller forces. The front-side impeller forces are represented by the sum of the discharge force and suction force acting on a front side 56 of the impeller 18. The back-side impeller forces are represented by the sum of the balancing force and the discharge force acting upon the back side 58 of the impeller 18. A back-side discharge force acting upon the annular surface 62 of the back side 58 of the impeller 18 opposes a front-side discharge force acting upon the curved annular surface of the front side 56 of the impeller 18. The balancing valve 20 can adjust the balancing force over a range limited by the area ratio, impeller geometry, and pump internal geometry, among other factors. In practice, the area ratio is tested by verifying stable operation of the thrust balancing system 118 during which an axial position of the impeller 18 ideally remains in an intermediate position without contacting a first limit 126 (FIG. 4) or a second limit 128 (FIG. 4).

The second wear ring assembly 72 forms a filter for blocking all or most particles in the pumped fluid which are larger than the wear ring gap 80 or clearance between the second inner ring 88 and the second outer ring 90. Particles or contaminates in the discharge chamber 76 are prevented from entering the balancing chamber 78 in accordance with the filtering properties of the second wear ring assembly 72. The second wear ring assembly 72 protects the containment member 44, the cylindrical portion 64 of the impeller 18, and the first magnet assembly 94 from particles which would otherwise cause damage. Thus, the pump 10 is capable of pumping particle laden fluids.

The first outer ring 86 is preferably resiliently biased axially frontward or toward the inlet 24. The second outer ring 90 is preferably resilient biased backwards or toward the dry-end 114. The first outer ring 86 and the second outer ring 90 are radially retained by friction such that the radial bearing 16 primarily supports radial loads acting on the impeller 18. The radial bearing 16 optimally supports all radial forces acting on the impeller 18 during normal operation of the pump 10. Axially biasing of the first outer ring 86 and the second outer ring 90 retains the outer rings to allow ready removal of the impeller 18 from the pump 10 for servicing. Conversely, axial biasing of the outer rings simplifies assembly or reassembly of the impeller 18 within the pump. The first outer ring 86 and the second outer ring 90 are preferably biased by corrosion-resistant springs 95 such as coil springs, leaf springs, spiral springs, or the like. The springs 95 may be encapsulated in an elastomer or coated with an elastomer to improve corrosion-resistance.

The first inner ring 84, the second inner ring 88, the first outer ring 86, and the second outer ring 90 are preferably composed of ceramic material because ceramic materials tend to hold their tolerances over their lifetime. In addition, smaller tolerances and clearances are possible with ceramic wear rings than for many metals, alloys, polymers, plastics, or other materials.

The impeller 18 has an impeller inlet diameter 96 and cylindrical portion diameter of the cylindrical portion 64. The radial bearing 16 preferably has a bearing diameter 100 that is less than both the impeller inlet diameter 96 and the cylindrical portion diameter. Here in a preferred embodiment, the bearing diameter 100 represents a diameter at an interface between the moving radial bearing 16 and the stationary shaft 14. The bearing diameter 100, and consequently the bearing surface area, is preferably minimized to a minimum bearing diameter to enhance dry-run performance, through the reduction of the sliding velocity at the interface of the radial bearing 16. The minimum bearing diameter, and consequently the minimum bearing surface area, is great enough to handle a highest anticipated radial load during normal operation of the pump.

In a preferred embodiment, the radial bearing 16 comprises a carbon bushing 98 having a minimum bearing diameter minimized to an extent to permit dry-running of the pump for a continuous period of at least one half hour. Depending upon the highest anticipated radial load among other factors, a carbon bushing 98 having a suitable diameter and construction may permit dry-running for as long as one hour or more.

In another preferred embodiment, the radial bearing comprises a ceramic bushing and has a minimum bearing diameter minimized to an extent to permit dry-running of the pump for a continuous period of at least five minutes. Depending upon the highest anticipated radial load among other factors, a ceramic bushing may permit dry-running for as long as fifteen minutes or more. Silicon carbide is preferred for the ceramic bushing, although in alternate embodiments other ceramic materials may be used. Although a ceramic bushing or carbon bushing 98 is preferably housed in a bearing retainer 102 to form the radial bearing 16, in alternate embodiments, ceramic pads or carbon pads may be housed in a bearing retainer 102 to form an alternate radial bearing.

The radial bearing 16 is disposed within an impeller recess 34 such that the radial bearing 16 extends or spans over a predetermined axial region 104 of the shaft 14. The predetermined axial region 104 is located near or at a center of gravity of the impeller 18 and near or at a center of external radial forces acting upon the impeller 18. To extend over the predetermined axial region 104, which optimally includes both the center of gravity and a center of external radial forces, the radial bearing 16 may comprise multiple bushings or pads.

Positioning the radial bearing 16 at the center of external radial forces acting upon the impeller 18 improves the radial load handling of the radial bearing 16 during the normal pumping of a liquid; especially where the radial bearing 16 is well-lubricated by the pumped liquid. The main external forces acting upon the impeller 18 during the normal pumping of a liquid are generally uneven forces from hydrodynamic interactions between the impeller 18 and a housing cavity 22 of the pump. In contrast, the main forces during dry-running of the pump tend to be the weight of the impeller 18 and any weight imbalance in the impeller 18. Positioning the radial bearing 16 at the center of gravity of the impeller 18 minimizes friction and increases resistance against dry-running damage which may otherwise occur to the radial bearing 16.

Figure 2:
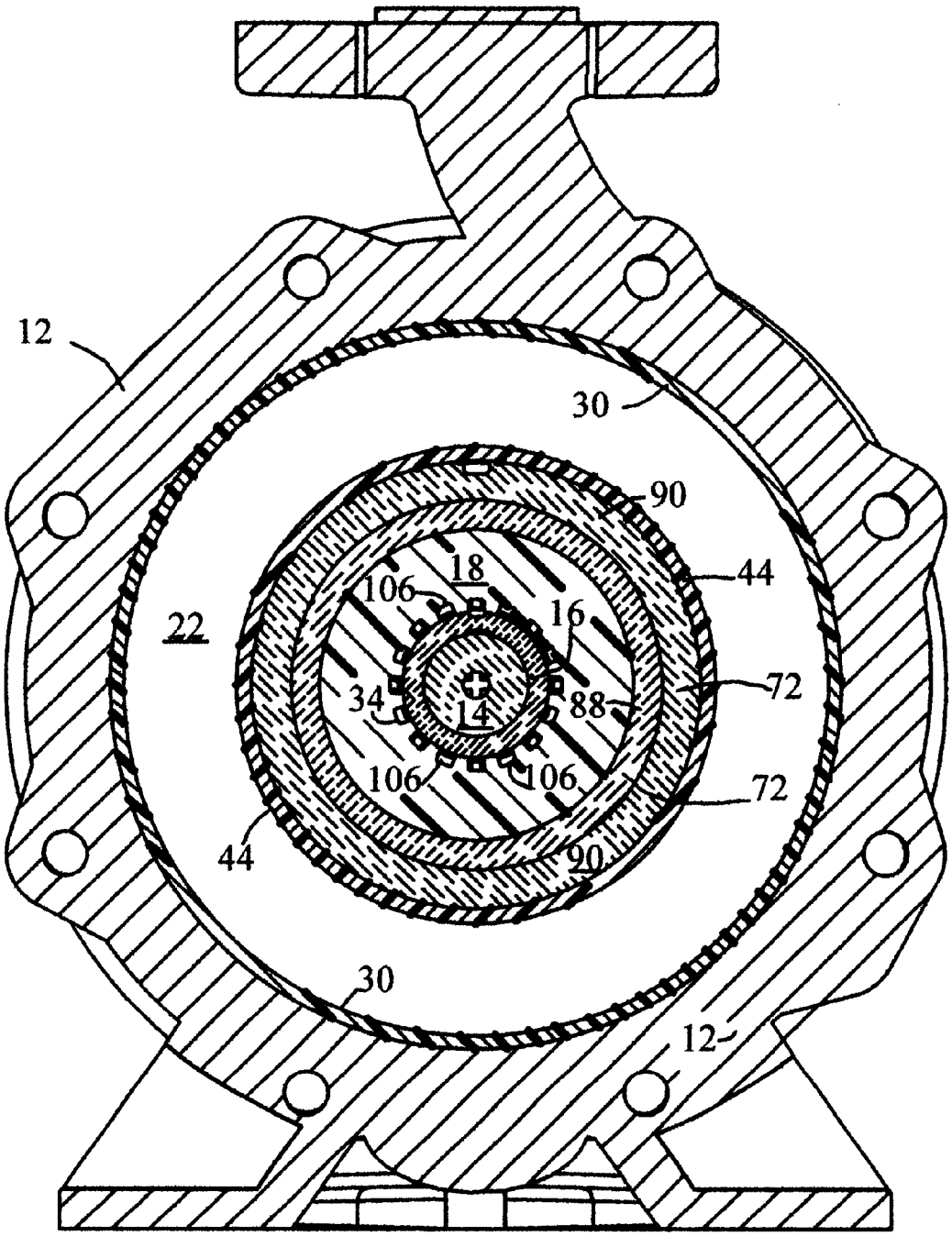
FIG. 2 is a cross-sectional view of the pump as viewed along reference line 2—2 of FIG. 1.

The radial bearing 16 is mated, interlocked, or otherwise mechanically joined with the impeller recess 34 to preferably define a series of spline-like openings 106 between the impeller recess 34 and the radial bearing 16, as best illustrated in FIG. 2. The impeller recess 34, the radial bearing exterior, or both may contain axial channels to form the spline-like openings 106. The spline-like openings 106 allow pumped fluid to travel from the second wear ring assembly 72, around a back side 58 of the impeller 18, through the vent 48 and back to the suction chamber 74. The fluid flows around the radial bearing 16 to provide cooling and lubrication for the radial bearing 16 which promotes pump longevity.

A first magnet assembly 94 is preferably associated with the impeller 18 such that the first magnet assembly 94 and the impeller 18 rotate simultaneously. The first magnet assembly 94 may be integrated into the impeller 18 as shown in FIG. 1. A second magnet assembly 108 is preferably coaxially oriented with respect to the first magnet assembly 94. The second magnet assembly 108 permits coupling to a drive shaft 110 through a containment member 44. The second magnet assembly 108 is carried by a rotor 92. A drive motor 93 is capable of rotating the drive shaft 110 and the rotor 92.

The containment member 44 is oriented between the first magnet assembly 94 and the second magnet assembly 108. The containment member 44 of the pump is sealed to the housing 12 for containing the pumped fluid to a wet-end 112 of the pump and isolating the pumped fluid from a dry-end 114 of the pump.

The containment member 44 is preferably made from a dielectric. For example, the containment member 44 is preferably composed of a reinforced-polymer, a reinforced-plastic, a plastic composite, a polymer composite, a ceramic, a ceramic composite, a reinforced ceramic or the like. Multiple dielectric layers 116 may be used to add structural strength to the containment member 44 as illustrated in FIG. 1. Notwithstanding the foregoing composition of the containment member 44, alternate embodiments may use metallic fibers to reinforce the dielectric, a metallic containment shell instead of a dielectric one, or a single layer of dielectric instead of multiple layers.

The thrust balancing system 118 includes a thrust balancing valve 20 acting in cooperation with the second wear ring assembly 72, the radial ribs 82 of the containment member 44, the spline-like openings 106, and an impeller back side 58. The impeller back side 58 has an impeller back surface area including surfaces associated with the cylindrical portion 64 along with the impeller recess 34.

The thrust balancing valve 20 is preferably arranged so that the inner radius 120 of the ring 42 is less than a shaft radius 122 of the second end 52 of the shaft 14. Accordingly, the balancing valve 20 may close as the ring 42 contacts the second end 52 of the shaft 14. The impeller hub 36 preferably has an annular recess 134 for receiving the ring 42 and an opening 38 adjoining the annular recess 134. The opening 38 is preferably generally cylindrical and coextensive with an interior of the ring 42 to form an unrestricted flow path through the vent 48 to the suction chamber 74. The vent 48 preferably ranges in vent size from twenty to thirty thousands, although in alternate embodiments other vent sizes and ranges are possible and fall within the scope of the invention. The vent size represents any gap between the shaft 14 and the ring 42 capable of supporting fluid flow to the suction chamber 74 when the thrust balancing valve 20 is open.

The thrust balancing system 118 for balancing thrust on the impeller 18 uses a discharge chamber 76, a suction chamber 74, and a balancing chamber 78. The suction chamber 74 is in fluidic communication with the inlet 24 and is bounded by the first wear ring assembly 70 and the thrust-balancing valve in an open or closed state. The discharge chamber 76 is in fluidic communication with the outlet 26 and is bounded by the first wear ring assembly 70 and the second wear ring assembly 72. The balancing chamber 78 is bounded by the second wear ring assembly 72 and the thrust-balancing valve in an open or closed state. The vent size adjusts so that a pressure in the balancing chamber 78 balances axial forces on the impeller 18 to minimize any net axial forces on the impeller 18.

Figure 3:
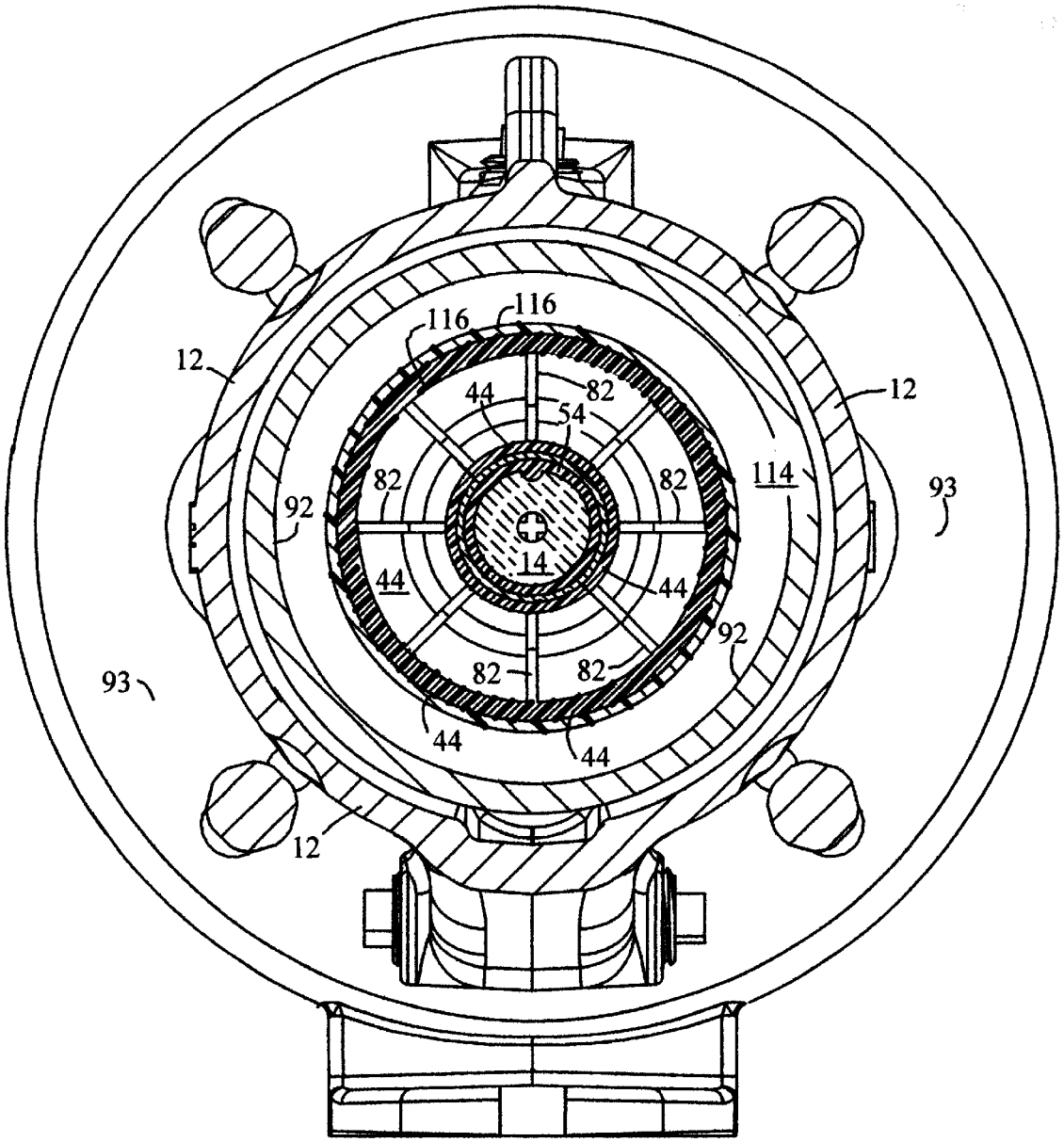
FIG. 3 is a cross-sectional view of the pump as viewed along reference line 3—3 of FIG. 1.

In general, radial ribs (i.e. radial ribs 82) may be placed on any radially extending surface starting inward from an outer radius or circumference of the second inner ring 88. Here, the containment member 44 preferably has radial ribs 82 as shown in FIG. 3. The radial ribs 82 comprise ridges projecting frontward (toward the inlet 24) from an interior of the containment member 44 and extending radially along the interior. The radial ribs 82 do not adversely affect the loading on the auxiliary axial thrust bearing 132 because the axial load balance is preferably maintained during normal operation without frictional contact or with minimal intermittent frictional contact between the auxiliary thrust bearing 132 and a rotating ring (i.e. first inner ring 84) of the first wear ring assembly 70. Thus, the radial ribs 82 prevent centrifuging of particulate matter in the fluid without increasing the load on the pump 10.

The radial ribs 82 cooperate with the thrust balancing valve 20 to enhance the operation of the axial load balancing of the impeller 18 in addition to directing particulate matter outside of the pump 10. The radial ribs 82 increase the uniformity of pressure and the pressure at the valve 20. The increased pressure differential at the thrust balancing valve 20 produces greater stability in axial load balancing. Moreover, the increased pressure contributes toward enhanced lubrication of the radial bearing 16.

Figure 5:
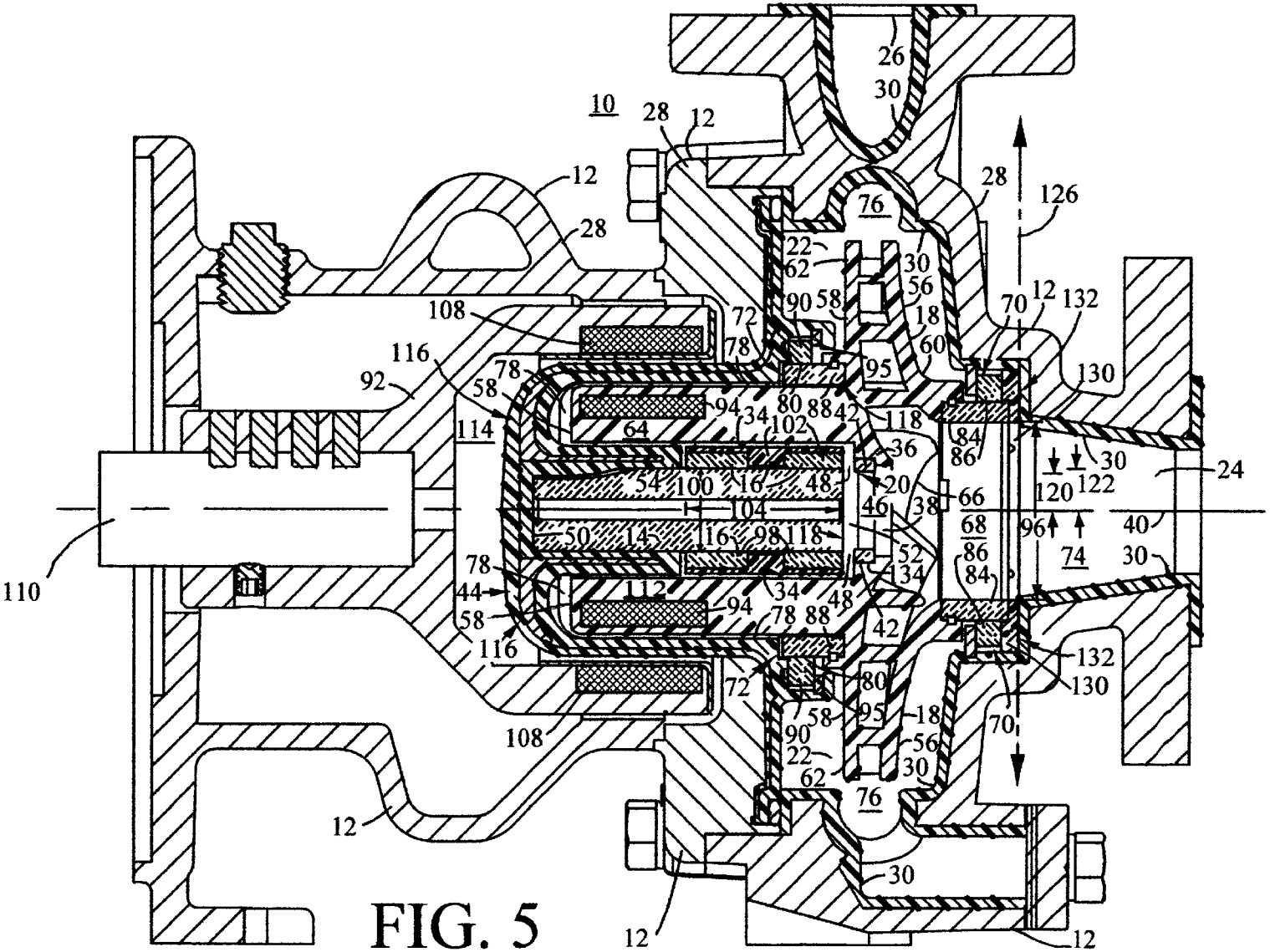
FIG. 5 is a cross-sectional view of a pump of FIG. 1 at a front limit within a range of axial positions of the impeller.

During operation of the pump, the thrust balancing valve 20 is preferably partially open as shown in FIG. 4 to balance axial forces on the impeller 18, or fully open to compensate for axial forces with the auxiliary thrust bearing 132 in an active state as shown in FIG. 5. The impeller 18 moves to an axial position within an axial position range which is stable based on the particular axial load present. The axial load may vary with changes in the pump operating point, changes in the specific gravity of the pumped fluid, the degree of cavitation, and the proportion of entrained gas in the liquid, among other factors.

FIG. 4 illustrates an intermediate axial position 124 of the impeller 18 which lies within a potential range of axial positions between a first limit 126 and a second limit 128. During normal operation of the pump, the axial load balancing system optimally moves the impeller 18 to an intermediate axial position 124, within the range of axial positions, that exactly balances the axial forces upon the impeller 18 so that the net axial forces acting upon the impeller 18 approach or equal zero.

The first limit 126 or forward limit of axial travel for the impeller 18 is defined by contact between the thrust pad 130 and the rotating ring (i.e. first inner ring 84) of the wear first ring assembly 70, as illustrated in FIG. 5. The forward direction of the impeller 18 is toward the inlet 24 of the pump. If the axial thrust is so extreme or so transient that the valve 20 cannot compensate for the axial thrust, an auxiliary axial thrust bearing 132 is formed between a rotating ring of the first wear ring assembly 70 and the thrust pad 130.

The thrust pad 130 is preferably a generally annular member affixed to a pump interior near the inlet 24 within the suction chamber 74 (i.e. first inner ring 84). The thrust pad 130 may have a recess adapted to receive the rotating ring. The thrust pad 130 preferably is composed of a polymer, a fiber-reinforced polymer, a polymer composite, a plastic, a fiber-reinforced plastic, a plastic composite, a ceramic, or a corrosion resistant material. For example, polytetrafluoroethylene may be used to form at least the contact portion 136 of the thrust pad 130 that contacts the rotating ring as described above under unusual pump operating conditions of high axial thrust.

The second limit 128 or backward limit of axial travel for the impeller 18 is defined by contact between the ring 42 and the second end 52 of the shaft 14 associated with the valve 20, as illustrated in FIG. 1. The second limit 128 is not generally reached during normal operation of the pump 10, but may be reached when the pump 10 is turned off or when axial load transients occur. Advantageously, the ring 42 may be removed from the impeller hub 36 to be replaced with another ring having a different thickness so that the second limit 128 of axial travel may be adjusted to suit the operating point and specific gravity of the pumped fluid, among other factors.

In FIG. 4, arrows indicate the direction of primary fluid flow 138 and secondary fluid flow 140 within the pump during normal operation when the impeller 18 is in an intermediate axial position 124. The primary fluid flow 138 enters an inlet 24 of the pump to a suction chamber 74. From the suction chamber 74 the fluid is drawn into the impeller 18 and released into a discharge chamber 76. The primary fluid flow 138 then travels from the discharge chamber 76 to the outlet 26 of the pump.

The secondary fluid flow 140 is lesser in volume than the primary fluid flow 138, but the second fluid flow is critical to the thrust balancing of axial loads on the impeller 18 in accordance with the present invention. First, the secondary fluid flow 140 travels from the discharge chamber 76 through a gap 80 in the second wear ring assembly 72. Second, the secondary fluid flow 140 travels backward in an annular gap between the containment member 44 and the cylindrical portion 64 of the impeller 18 as the impeller 18 rotates. Third, the secondary fluid flow 140 is disrupted and enhanced in pressure and pressure uniformity by radially extending ribs in the interior of the containment member 44. Fourth, the secondary fluid flow 140 is sucked frontward between the impeller recess 34 and radial bearing 16 within the spline-like openings 106. Finally, the secondary fluid flow 140 traverses the vent 20 under the influence of a pressure differential, passes through the opening 38, and returns to the suction chamber 74. The secondary fluid flow 140 is preferably sufficient to expel particulate matter, which was drawn into the secondary fluid flow 140, back into the suction chamber 74. The thrust balancing system 118 comprises a hydraulic system for adjusting the hydrodynamic characteristics of secondary fluid flow 140 path to compensate for fluctuations in axial load and for balancing axial load upon the impeller 18.

Figure 6:
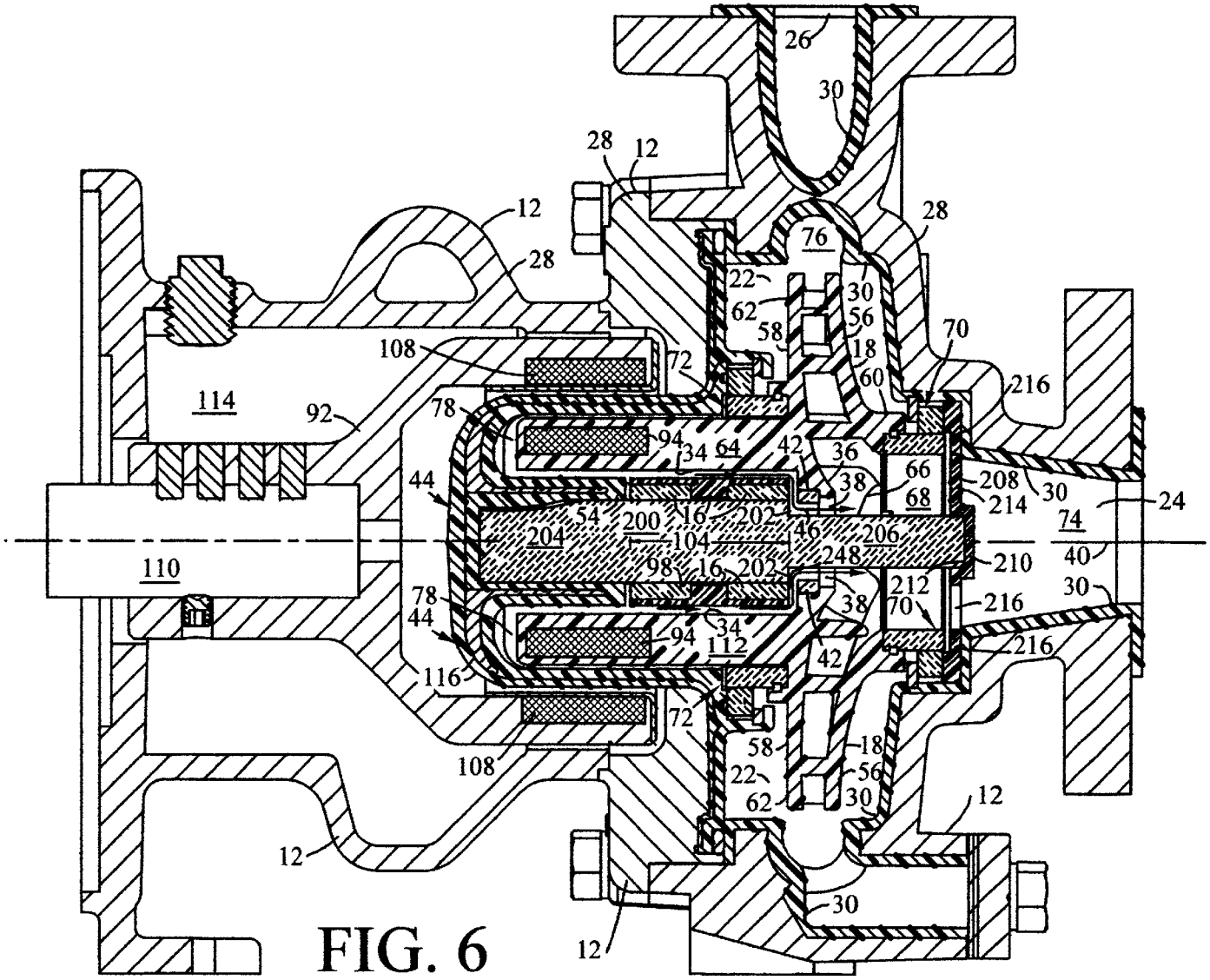
FIG. 6 is a cross-sectional view of an alternate embodiment of a centrifugal magnetic-drive pump in accordance with the invention.

FIG. 6 illustrates an alternate embodiment of the pump that is similar to the embodiment shown in FIG. 1 through FIG. 5, except the shaft 200 and shaft mounting arrangement in FIG. 6 is different. The shaft 200 of FIG. 6 has a step 202 between a first shaft section 204 and a second shaft section 206. The first shaft section 204 has a first diameter greater than a second diameter of the second shaft section 206. Sufficient clearance exists between the second diameter and the ring to form a variable orifice 248. The step 202 comprises a shoulder that forms a stop for the ring. The step 202 is preferably orthogonal in a radial cross-section of the shaft, although in alternate embodiments the step 202 is curved in the radial cross-section of the shaft.

The shaft 200 is supported by the containment member 44 and a shaft support 208 member. The shaft support 208 member is located toward the inlet of the pump within the suction chamber. The shaft support 208 generally has a hub 210 with a recess 212 for receiving the shaft 200, spokes 214 extending from the hub 210 to a rim 216. The rim 216 is mechanically attached or press-fitted to the housing. The shaft support 208 is preferably made of a corrosion-resistant material, such as a polymer composite, or the shaft support 208 has a corrosion-resistant coating upon a rigid metal or alloy base.

While a stationary-shaft version of a centrifugal pump is disclosed herein, the general principals of the invention disclosed herein may be applied equally to a centrifugal pump having a rotating shaft. Similarly, while the ring for the thrust balancing valve was depicted as a separate element herein, in alternate embodiments the ring may be formed as an integral collar or an annular protrusion integrated into the impeller or integrally molded as a portion of the impeller. In another alternate embodiment, a disk could be attached to a stepped shaft or a cantilevered shaft to act as the stationary side of the thrust balancing valve.

Figure 7:
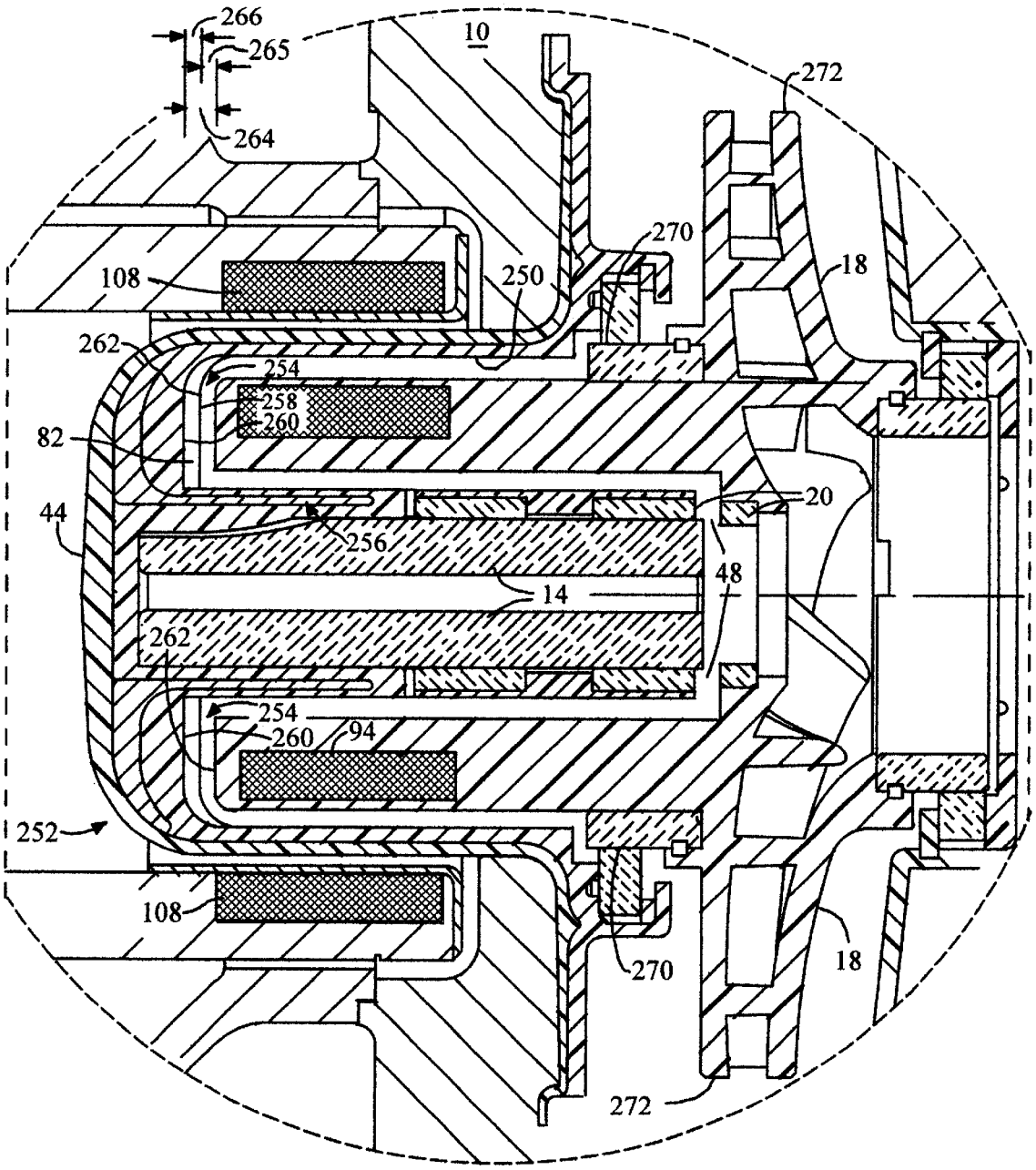
FIG. 7 is a cross-sectional enlargement of the circular region labeled 7 in FIG. 1.

FIG. 7 shows an enlarged view of a circular region of FIG. 1, as indicated by reference numeral 7. Like reference numerals in FIG. 1 and FIG. 7 indicate like elements. The balancing chamber 78 is defined by a volume between the second wear ring assembly 72 and the thrust balancing valve 20. The thrust balancing valve 20 is associated with an opening 38 in the impeller hub 36. The opening 38 provides a channel between the balancing chamber 78 and the suction chamber 74. The thrust balancing valve 20 defines a variable orifice 48 for fluidic communication between the balancing chamber 78 and the suction chamber 74. The second wear ring assembly 72 provides a fixed orifice 270 that remains uniform in opening size regardless of an axial position of the impeller 18. In contrast, the variable orifice 48 of the thrust balancing valve 20 varies in opening size with the axial position of the impeller 18.

Figure 8:
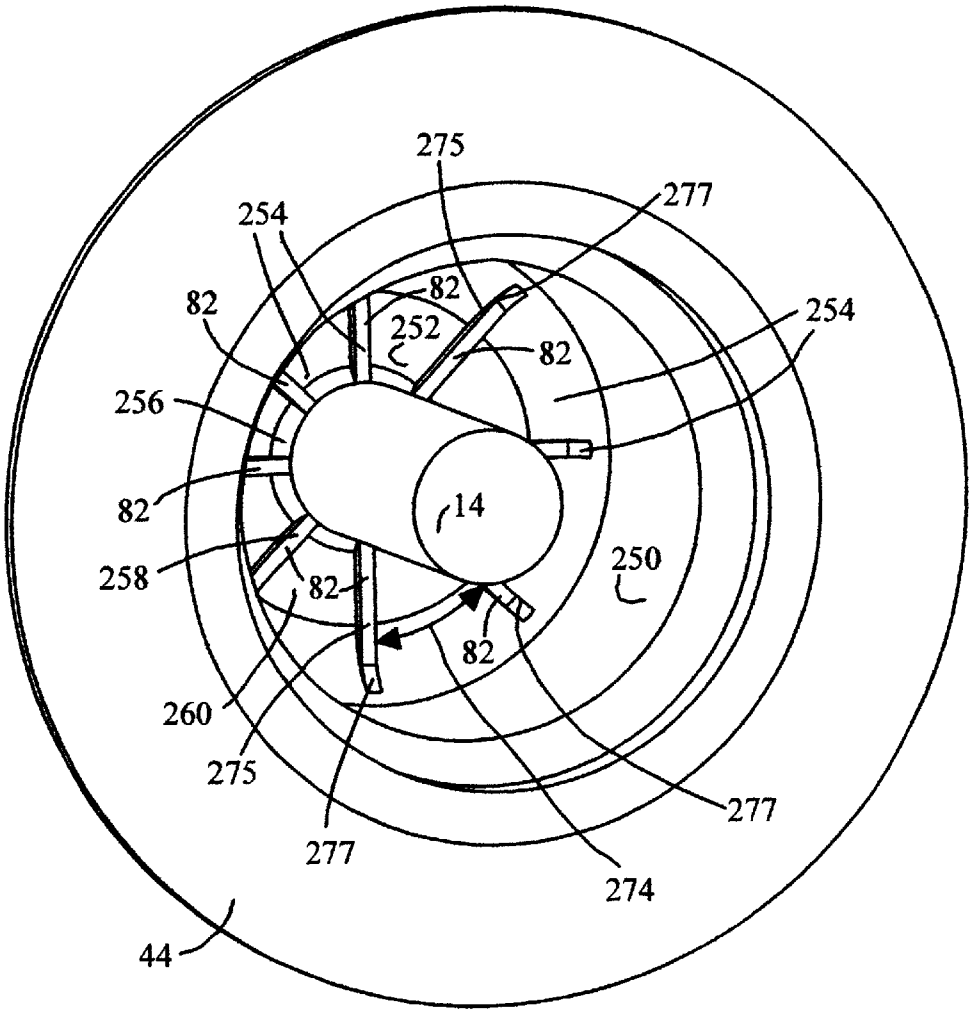
FIG. 8 is a perspective view of a containment member in accordance with the invention.

As shown in FIG. 7 and FIG. 8, the containment member 44 has a substantially cylindrical portion 250 that intersects with a rear wall 252 for containing the pumped fluid. The rear wall 252 preferably curves to meet the generally cylindrical portion 250. The rear wall 252 includes an interior surface 254. Although the interior surface 254 is generally annular in FIG. 8, in alternate embodiments the interior surface 254 may be substantially circular or have any other suitable geometric shape. The wall 252 may include a rear shaft support 256 axially extending from the interior surface 254.

The interior surface 254 of the wall 252 has different elevations for inhibiting rotational flow and reducing angular velocity of the fluid. The interior surface 254 comprises at least one higher elevation 258 axially extending from a lower elevation 260. A higher elevation 258 may include any repetitive or known pattern of island regions that provide surface roughness to the interior surface 254 for increasing the static pressure of the fluid. The interior surface 254 of the wall 252 is disposed adjacent to a rear portion 262 of the impeller 18 to reduce the angular velocity of the fluid and enhance the performance of the thrust balancing system 118.

In one embodiment, the interior surface 254 comprises a plurality of ribs 82 of higher elevation 258 extending axially from a lower elevation 260 of the interior surface 254.

Each rib 82 has a cross-sectional contour that generally tracks an impeller cross-sectional contour of a rear portion 262 of the impeller 18 to maintain a generally uniform minimum axial rib clearance 265 between an outermost axial extent of the ribs 82 and the rear portion 262. For example, as shown the rear portion 262 of the impeller 18 is substantially planar toward its center and arched toward the edges of the rear portion 262. Consequently, the ribs 82 preferably have a rectilinear profile at smaller radii and an arcuate profile at larger radii with respect to the shaft axis 40 to maintain a generally uniform minimum axial rib clearance 265. Although the minimum axial rib clearance 265 is preferably as small as possible to reliably avoid frictional or rubbing contact between the ribs 82 and a rear portion 262 of the impeller 18, greater axial rib clearances fall within the scope of the invention because the axial position of the impeller 18 may change in accordance with the thrust balancing system 118.

Each rib 82 has a rib height 266 that protrudes axially from a lower elevation 260 of the interior surface 254. A total axial clearance 264 refers to a rib height 266 plus a minimum axial rib clearance 265 between an outermost axial extent of the rib 82 and a rear portion 262 of the impeller 18 when the impeller 18 is at the second limit 128. That is, the total axial clearance 264 represents the axial clearance between a lower elevation 260 of the interior surface 254 and the rear portion 262 of the impeller 18. Although the rib height 266 may be any dimension that is generally commensurate with the magnitude of the total axial clearance 264, in a preferred configuration the rib height 266 falls within a range from approximately three-quarters of the total axial clearance 264 to approximately equal to, but not exactly equal to, the total axial clearance 264. If the rib height 266 is approximately equal to, but slightly less than, the total axial clearance 264, the ribs 82 may theoretically facilitate the greatest increase in the static pressure at the variable orifice 48. In particular, if the rib height 266 approximately equals the total axial clearance 264 and if the impeller axial position is consistent with activity near or at the second limit 128, a first static pressure presented to the thrust balancing valve 20 theoretically approaches or equals a second static pressure at a periphery 272 of the impeller 18 in the discharge chamber 76. The second static pressure at the periphery 272 represents an ideal maximum value for the first static pressure presented to the thrust balancing valve 20. If the rib height 266 is approximately equal to three-quarters of the total axial clearance 264, the ribs 84 have an ample safety margin for avoiding frictional contact between the ribs 82 and the impeller 18 and the power required to drive the pump shaft 14 is reduced as the rib height 266 decreases from a rib height as close as possible to the total axial clearance 264 without equaling the total axial clearance 264.

As best illustrated in FIG. 8, the ribs 82 comprise stationary vanes on a rear interior surface 254 of the containment member 44. The stationary vanes may have a rib cross-sectional contour that tracks an impeller cross-sectional profile of a rear portion 262 of the impeller 18 to maintain a substantially uniform minimum axial rib clearance 265 between the ribs 82 and rear portion 262. For example, the cross-sectional contour may include a generally linear portion 275 and an arcuate portion 277 tracking a curved cross-sectional profile of a rear portion 262 of the impeller 18 to maintain a generally uniform minimum axial rib clearance 265 between the stationary vanes and the rear portion 262.

The ribs 82 are preferably spaced apart by generally uniform angular intervals 274 within a range from approximately one-hundred eighty degrees to approximately eighteen degrees. Although alternate embodiments may include spacings closer than eighteen degrees, if too many ribs 82 are placed one the interior surface 254 of the containment member 44, the effectiveness of the ribs 82 decreases because the aggregate group of ribs, in effect, presents a solid surface to the fluid instead of a rough surface that disrupts the spiral flow. The number of ribs 82 protruding axially from the rear interior surface 254 of the containment member 44 preferably ranges from two to twenty to modify the flow to enhance the static pressure at the variable orifice 48 of the thrust balancing valve 20.

In an alternate embodiment, the ribs 82 have a first radius less than a second radius of the interior surface 254 or the cylindrical portion 250 to reduce the power required to drive the pump shaft 14. In another alternate embodiment, the ribs 82 comprise generally rectilinear strips spaced apart by generally uniform angular sectors. In still another alternate embodiment, the interior surface 254 comprises a plurality of curved elevations which are curved within a plane of the interior surface 254. The curved elevations may form a spiral pattern, a scroll-shape, or other shapes which resemble shapes of the vanes of open impellers. The curved elevations extend axially frontward from a lower elevation 260 of the interior surface 254.

The containment member 44 of FIG. 8 is installed between the first magnet assembly 94 and the second magnet assembly 108 as shown in FIG. 7. A rear portion 262 of the impeller 18 and the ribbed rear interior surface 254 of the containment member 44 cooperate to provide a generally uniform static pressure within the containment member 44 versus an internal radius of the containment member 44 relative to a shaft axis 40 of the magnetic-drive pump 10. As the impeller 18 moves forward toward the inlet 24, the variable orifice 48 opens allowing more secondary flow through the variable orifice 48, which in turn reduces the static pressure within the balancing chamber 78. However, the variable orifice 48 requires sufficient static pressure to achieve an axial position of balance for the impeller 18 between its extreme axial positions. The radial ribs 82 increase the static fluidic pressure presented to the variable orifice 48 such that thrust balancing may be provided even when the variable orifice 48 is fully opened.

The radial ribs 82 increase the static pressure for the thrust balancing valve 20 to improve the reliability and extend the effective operating range of thrust balancing system 118 in the following manner. In general, the interior surface 254 with radial ribs 82 reduces an average fluid angular velocity to less than approximately one-half of the impeller angular velocity to increase the static pressure at the thrust balancing valve 20. The fluid between the impeller 18 and the rear interior surface 254 with ribs 82 rotates with an average fluid angular velocity which is less than one-half of the average impeller angular velocity because the surface roughness provided by the interior surface 254 of containment member 44. The rotation of the impeller 18 adjacent to the stationary interior surface 254 promotes a uniform static pressure within the balancing chamber 78 or the containment member 44 versus an internal radius of the pump 10 relative to a shaft axis 40. Thus, the static pressure remains generally uniform from a smaller radius of the variable orifice 48 to a larger radius of the cylindrical portion 250 of the containment member 44.

The radial ribs 82 minimize the static pressure drop caused by the rotation of the fluid in the balancing chamber 78 to increase the effectiveness of the thrust balancing system 118. The radial ribs 82 can potentially increase the static pressure at the thrust balancing value to approach the static pressure available at the impeller periphery 272 less any drop in static pressure at the fixed orifice 270 of the second wear ring assembly 72. At most, the radial ribs 82 can increase a first static pressure at the thrust balancing valve 20 to equal or approach a second static pressure at the second wear ring assembly 72 upon entry into the balancing chamber 78. The cross-sectional surface area of the annular gap between the containment member 44 and the outer radius of the impeller 18 is preferably large enough to cause no appreciable drop in static pressure from fluid flowing from the second wear ring assembly 72 backwards toward a rear of the containment member 44. Similarly, the aggregate cross-sectional surface area of the axial clearances associated with the radial bearing 16 are preferably sufficiently large enough to cause no appreciable drop in static pressure of fluid flowing forward from a rear of the containment member 44 to the thrust balancing valve 20. At the least, the radial ribs 82 can increase the static pressure at the thrust balancing valve 20 to be greater than the static pressure due to an average rotational rate of one-half between the rear of the impeller 18 and the interior surface 254 of the containment member 44. Accordingly, the thrust balancing system 118 can function over a complete or greater flow range than would otherwise be possible.

Figure 9:
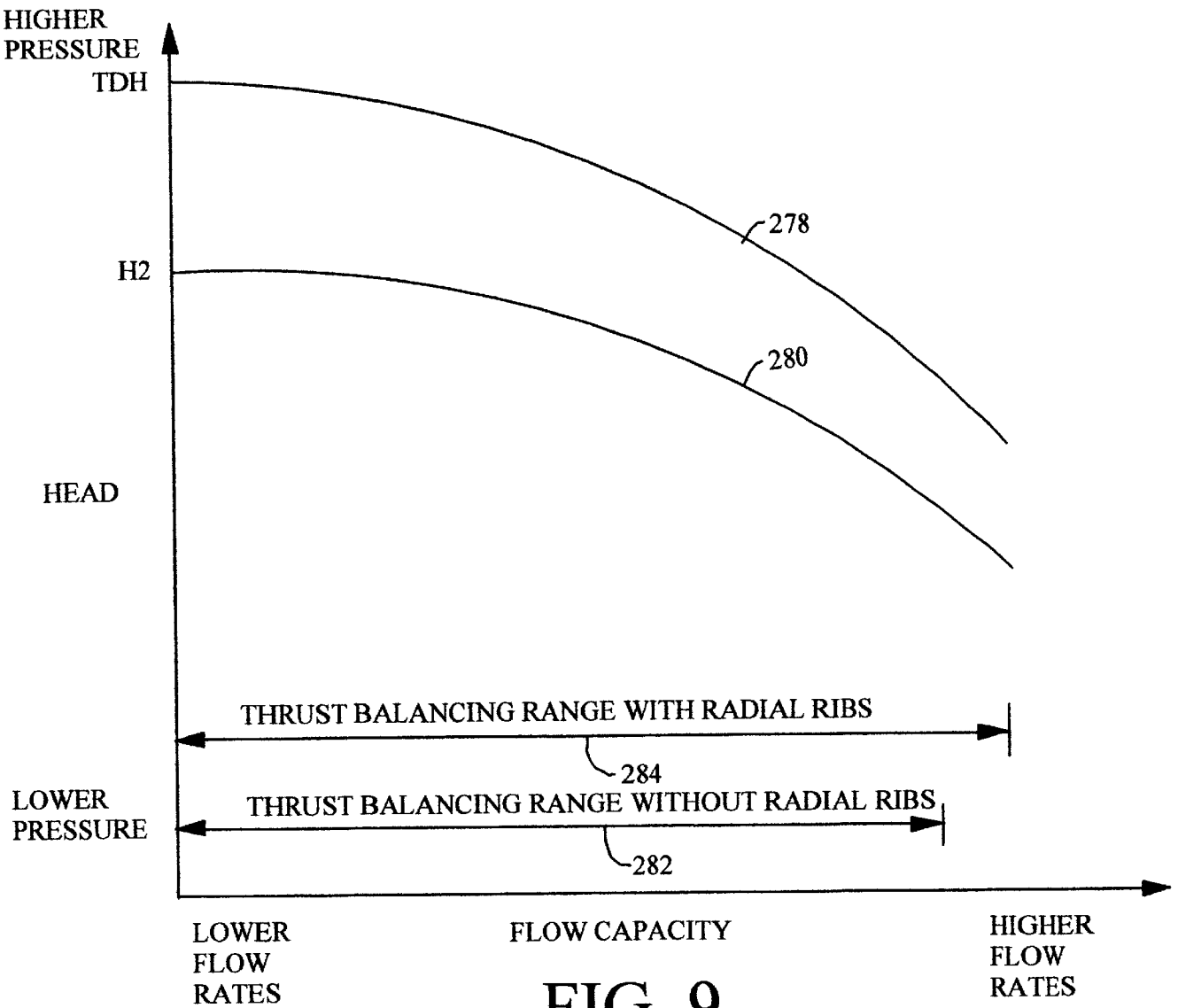
FIG. 9 is an illustrative graph of head versus flow capacity that shows an extended thrust balancing range of a pump in accordance with the invention.

FIG. 9 illustrates a curtailed operational range 282 of thrust balancing without radial ribs 82 and an extended operational range 284 of thrust balancing with radial ribs 82 on the interior surface 254 of containment member 44. The operational ranges (282, 284) are defined with reference to various characteristic curves of head versus capacity. The vertical axis shows head (e.g., in meters or feet) and the horizontal axis shows capacity (e.g., in cubic meters per hour or gallons per minute).

An upper curve 278 represents a characteristic curve of total dynamic head, whereas a lower curve 280 represents a characteristic curve of static head. The total dynamic head of the pump 10 represents the dynamic head plus the static head of the pumped fluid at the outlet 26. The dynamic head relates the energy associated with the flow of the fluid, whereas the static head relates to the energy associated with the outward pressure that is exerted on a pressure vessel or channel carrying the flow of the fluid.

In general, at higher flow rates of capacity and lower pressure head of the pump 10, the static pressure at the variable orifice 48 is reduced in comparison to lower flow rates and higher pressure output. At a maximum flow rate and a minimum pressure on the lower characteristic curve, a comparative thrust balancing system without radial ribs 82 on the containment member 44 no longer provides adequate static pressure to facilitate thrust balancing at an intermediate axial position. Instead, the impeller that does not have the benefit of interaction with radial ribs 82 might go forward toward the inlet 24 to one extreme, where an auxiliary axial bearing may absorb axial thrust and experience a frictional load.

As illustrated by the difference between the curtailed operational range 282 and the extended operational range 284 of thrust balancing, the radial ribs 82 tend to increase the maximum flow rate and decrease the minimum pressure at which the thrust balancing system 118 effectively maintains an intermediate position between the axially extreme positions. The intermediate axial position of the impeller 18 is significant because the intermediate axial position reduces wear that might otherwise occur to the auxiliary thrust bearing 132 and associated friction. The heat from the friction can shorten the longevity of the pump 10 by increasing the stress on polymeric compositions and magnetic materials within the pump 10.

Figure 10:
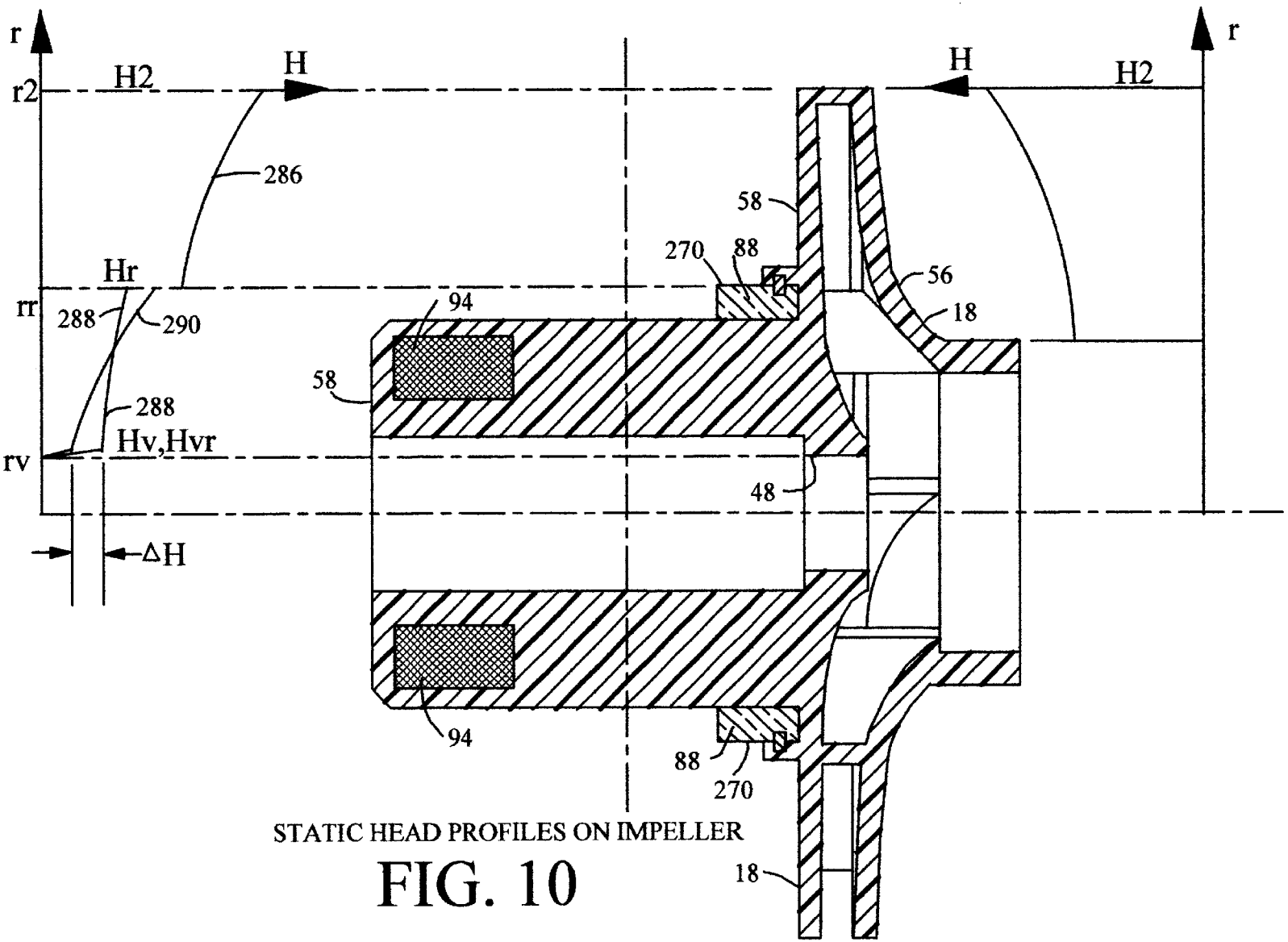
FIG. 10 is a cross-sectional view of an impeller that illustrates static head profiles acting on the impeller in accordance with the invention.

FIG. 10 illustrates the static forces applied to an impeller front side 56 and an impeller back side 58 at various internal pump radii measured from a shaft axis 40 of the pump 10. The axial forces on the impeller 18 that place the impeller 18 in a balanced axial position within the pump interior depend upon the sum of different static pressures pressing on the impeller front side 56 and the impeller back side 58. The vertical axis represents a radius relative to a shaft axis 40 of the pump 10. The horizontal axis represents a static pressure on the impeller 18 during operation of the pump 10.

The maximum static pressure is at a radius $r_2$ coextensive with a periphery 272 of the impeller 18 in the discharge chamber 76. The discontinuity of the upper curve 286 with respect to a first lower curve 288 and a second lower curve 290 represents a pressure drop associated with the fixed orifice 270, located at radius $r_r$. The fixed orifice 270 is defined by a clearance gap between the second outer ring 90 and the second inner ring 88 of the second wear ring assembly 72.

The change in pressure, $\Delta$ H, illustrates a pressure enhancement of radial ribs 82 in the containment member 44. The radial ribs 82 in the containment member 44 tend to produce a generally uniform pressure from the radius $r_r$ of the fixed orifice 270 to a radius $r_v$ of the variable orifice 48 of the thrust balancing valve 20, as illustrated by the generally vertical nature of the first lower curve 288. In contrast, the second lower curve 290 applies to a comparative pump that has a containment member 44 without radial ribs 82. The second lower curve 290 for the comparative pump, as opposed to the pump 10 of the invention, demonstrates an ordinary decline in the static pressure with a decrease of the radius of the balancing chamber 78 which may be overcome by the radial ribs 82.

The effectiveness of a thrust balancing system 118 is usually rated in terms of stiffness. Stiffness refers to the force required to restore the impeller 18 to an axially balanced position if the impeller 18 is displaced a given axial distance from the balanced position. The higher the restoring force per unit of displacement from the axially balanced position, the greater the stiffness of the thrust balancing system 118. The degree of stiffness of the thrust balancing system 118 depends upon sufficient static pressure present at the thrust balancing valve 20. The static pressure at the thrust balancing valve 20 depends upon the static pressure differential between suction and the pressure of the balancing chamber 78. The presence of the radial ribs 82 enhance the static pressure differential between the balancing chamber 78 pressure at the thrust balancing valve 20 and suction; hence, the stiffness of the thrust balancing system 118.

Figure 11:
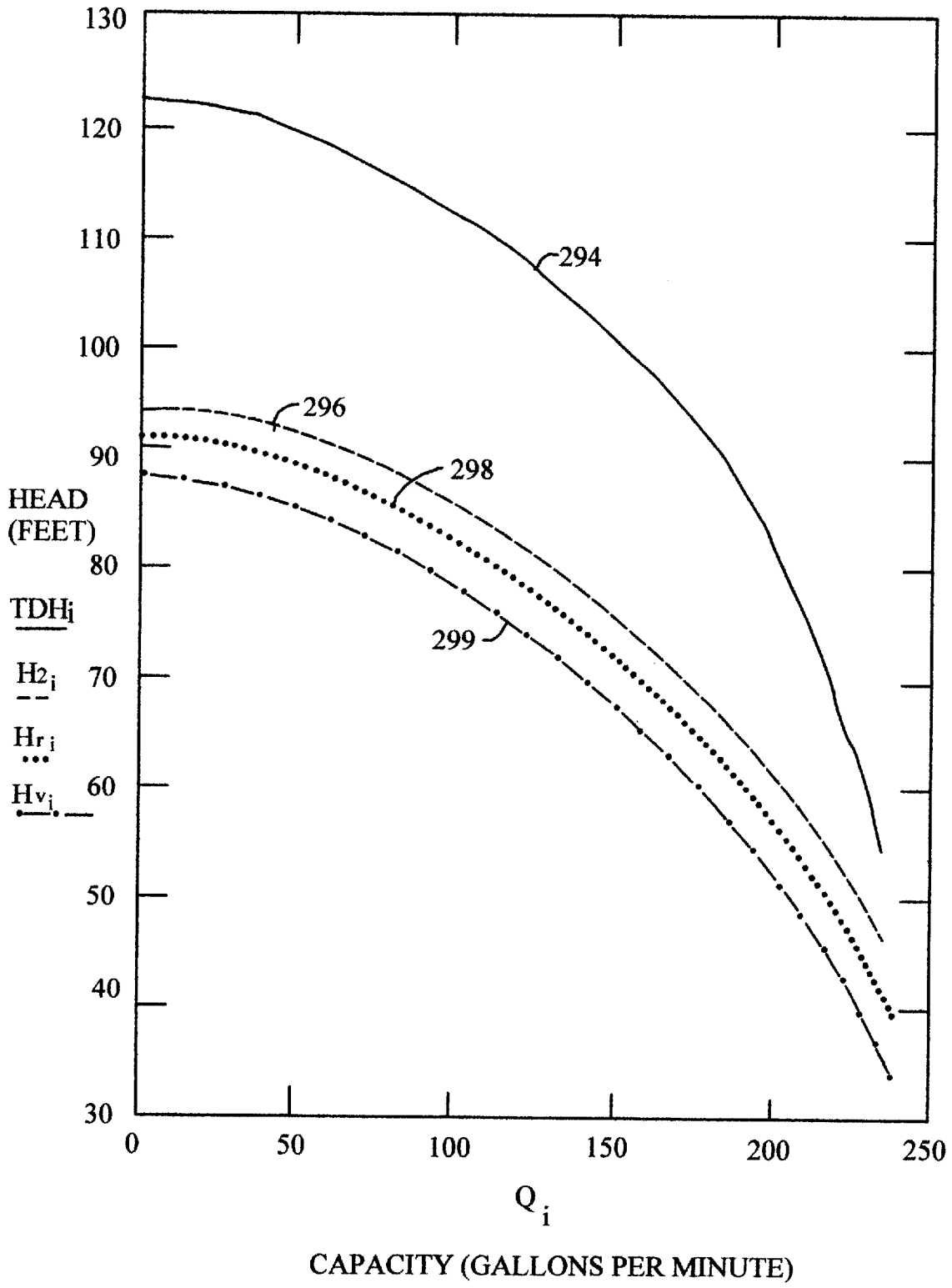
FIG. 11 illustrates various characteristic curves of head versus capacity at different internal pump locations in accordance with the invention.

FIG. 11 shows illustrative characteristic curves for the head (in feet) versus capacity (in gallons per minute) at various internal locations within the pump 10. The characteristic curves are merely presented as an example, and do not limit the scope of the invention to any particular characteristic curves of head versus capacity.

As illustrated by the solid line, a first curve 294 represents a total dynamic head of the pump 10. As illustrated by a dashed line, a second curve 296 represents a static head at the periphery 272 of the impeller 18 within a discharge chamber 76. The static head at the periphery 272 of the impeller 18 is the peak static head, which may be used as reference point for various static pressure drops within the pump 10. As illustrated by a dotted line, the third curve 298, represents a first static pressure drop between the impeller periphery 272 in the discharge chamber 76 and the fixed orifice 270 defined by the second wear ring.

As illustrated by alternating dots and dashes, the fourth curve 299 represents a lower boundary of a second static pressure drop from the fixed orifice 270 or the outer radius of the containment member 44 to the radius of the variable orifice 48. The third curve represents an upper boundary of the second static pressure drop from the fixed orifice 270 to the radius of the variable orifice. The second static pressure drop is theoretically eliminated when the total axial clearance 264 is approximately equal to, but slightly greater than the rib height 266 of the radial ribs 82. In such a case the angular velocity of the fluid theoretically equals or approaches zero.

By appropriate selection of rib geometry and an appropriate number of ribs 82, the average fluid angular velocity in radians per second may be theoretically reduced from one-half of the average impeller rotational velocity in accordance with the following equation:

$$w_a=\Omega(1-t/s)/2,$$

where t is the axial rib height 266 of the radial rib, s is the total axial clearance 264 between a lower elevation of the interior surface 254 and the rear portion 262 of the impeller 18 when the impeller is at the second limit 128, and Ω is the angular velocity of the impeller 18 in radians per second. However, the foregoing equation for $w_a$ only is applicable where the axial position of the impeller 18 provides an operational rib clearance that approximately equals the minimum axial rib clearance 265.

Any static pressure drop between the fixed orifice 270 and the variable orifice 48 may be estimated by the following equation:

$$H_{vr}=H_r-H_w-w_a^2(r_r^2-r_v^2)/8g,$$

wherein $H_{vr}$ is head drop in feet from the radius $r_r$ of the fixed orifice 270 to the radius $r_v$ of the variable orifice 48, $H_r$ is the head drop in feet from the radius at the impeller periphery 272 to the radius at the fixed orifice 270, $H_w$ is the head drop at the fixed orifice 270, $w_a$ is the angular velocity (in radians per second) of the fluid between the interior surface 254 and a rear portion 262 of the impeller 18, and g is the acceleration constant of 32.174 feet/second$^2$ from gravity. If it were possible to reduce the angular fluid velocity $w_a$ of the fluid to zero between the interior surface 254 and a rear portion 262 of the impeller 18 by the radial ribs 82, the head drop from the fixed orifice 270 to the variable orifice 48 would be $H_{vr}=H_r-H_w$. Further, if the magnitude of $H_w$ is small compared to $H_r$, $H_w$ may be ignored and $H_{vr}$ becomes $H_r$ for the ideal case.

$H_r$ is some static pressure value less than the head at the outer periphery 272 of the impeller 18. $H_r$ is the static pressure at the fixed orifice that is presented to the thrust balancing valve 20 in the ideal case. The following equation provides an estimate of $H_r$:

$$H_r=H_2-w_b^2(r_2^2-r_r^2)/8g,$$

wherein $H_2$ is the static head in feet at the periphery 272 of the impeller 18, $w_b$ is the fluid angular velocity of the fluid in the discharge chamber 76 in radians per second, $r_2$ is the radius at the impeller periphery 272, $r_r$ is the radius at the fixed orifice 270, and g is the acceleration constant of 32.174 feet/second from gravity. The angular velocity $w_b$ of the fluid around the impeller 18 at the discharge chamber 76 is not affected by the radial ribs 82 because of the isolation afforded by the first wear ring assembly 70 and the second wear ring assembly 72. The value of $H_2$ is related to the total dynamic head by a volute velocity constant that is a function of the specific speed of the impeller 18 as is known to those of ordinary skill in the art.

Figure 12:
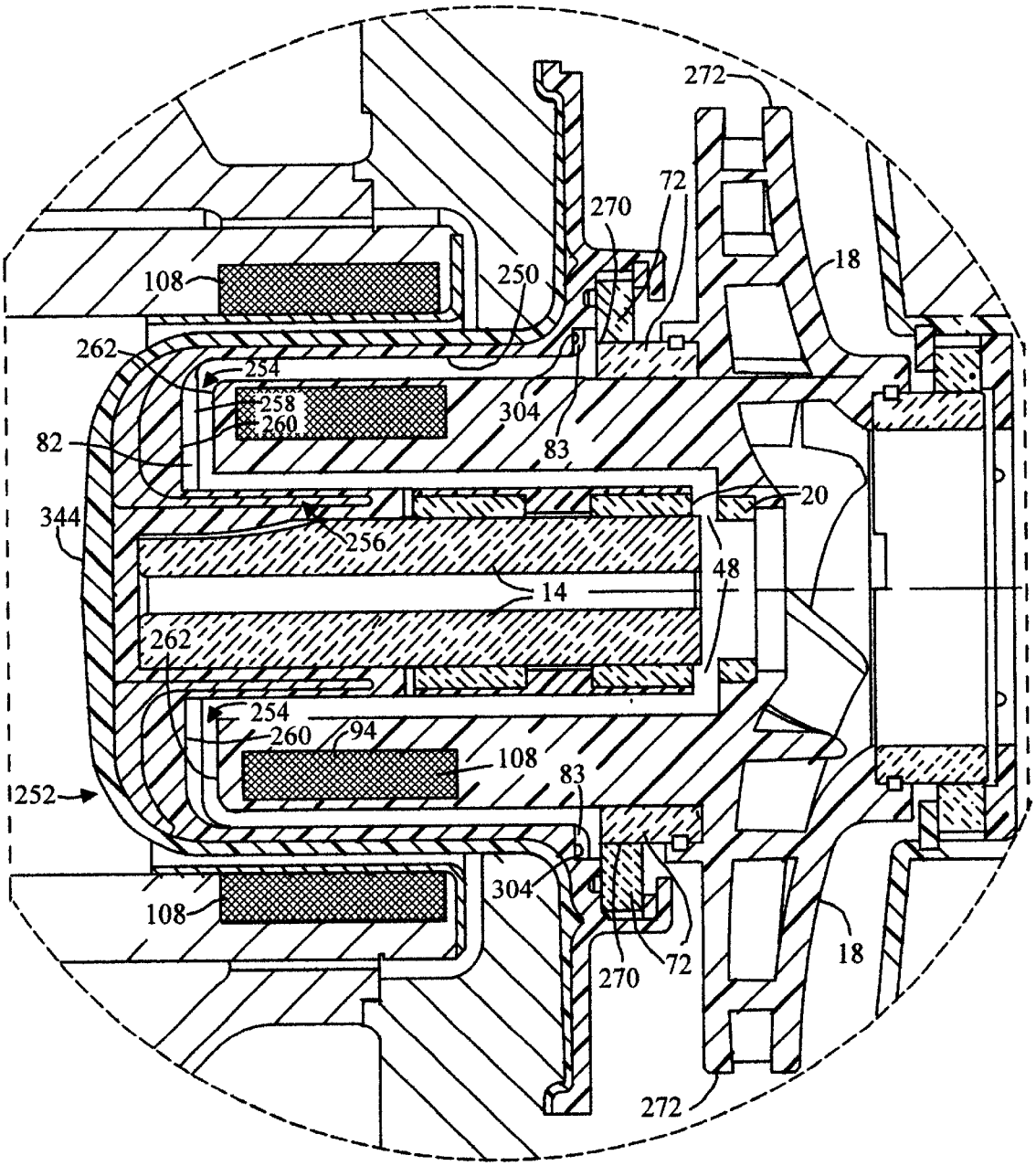
FIG. 12 is a cross-sectional enlargement of a pump section featuring an alternate embodiment of a containment member in accordance with the invention.
Figure 13:
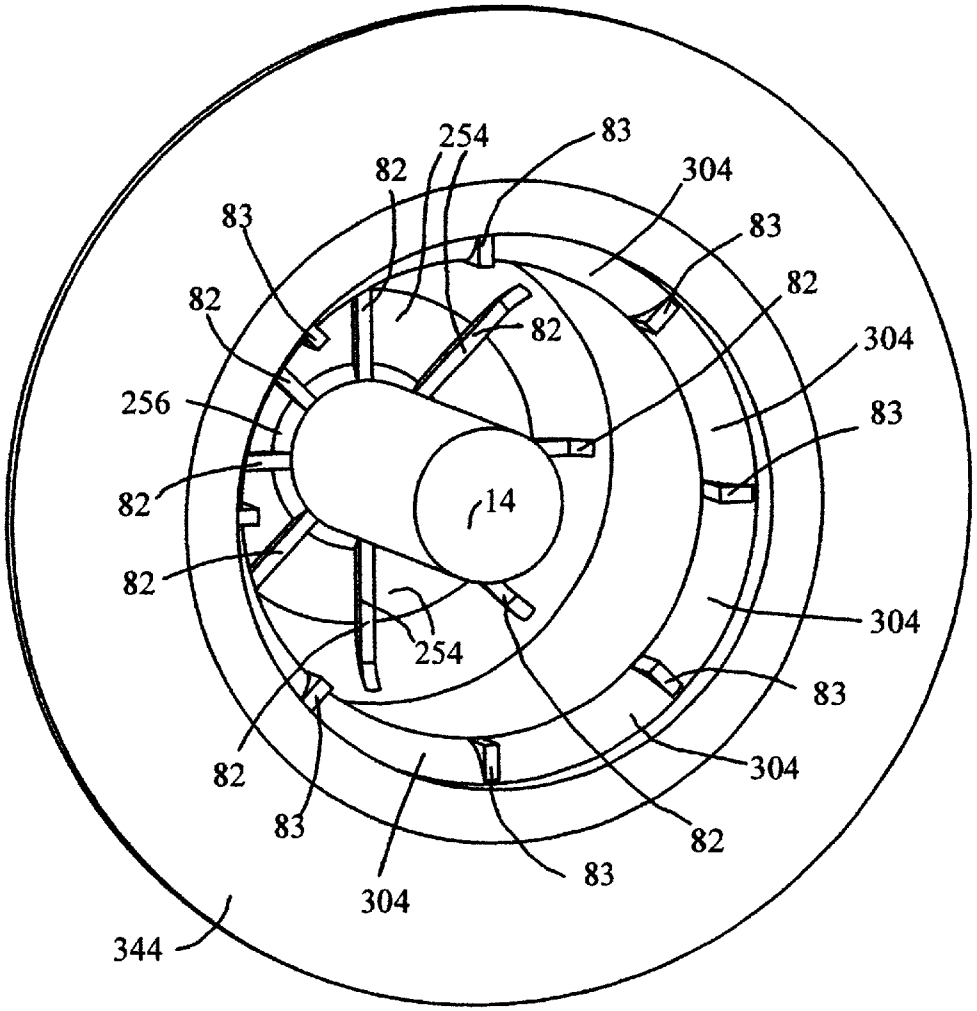
FIG. 13 is a perspective view of the alternate embodiment of the containment member shown in FIG. 12.

FIG. 12 shows a cross-sectional view of a pump which is similar to the pump 10 of FIG. 7 except the pump of FIG. 12 features a different containment member 344 with two sets of different radial ribs (82, 83). FIG. 13 shows a perspective view of an interior of the containment member 344 of FIG. 13. Like reference numbers indicate like elements in FIG. 7, FIG. 12 and FIG. 13.

The containment member 344 includes a first set of radial ribs 82 axially protruding from the rear interior surface 254 and a second set of radial ribs 83 axially protruding from a front interior surface 304 which is generally parallel to the rear interior surface 254. The second wear ring assembly 72 is located adjacent and frontward from the second set of radial ribs 83. The second set of radial ribs 83 typically do not modify the flow of the fluid and enhance the static pressure as much as the first set of ribs 82 do because the first set of ribs 82 generally covers a greater internal surface area of the containment member 344 than the second set does.

The foregoing detailed description is provided in sufficient detail to enable one of ordinary skill in the art to make and use the pump having the thrust balancing system. The foregoing detailed description is merely illustrative of several physical embodiments of the pump. Physical variations of the pump, not fully described in the specification, are encompassed within the purview of the claims. Accordingly, the narrow description of the elements in the specification should be used for general guidance rather than to unduly restrict the broader descriptions of the elements in the following claims.

We claim:

1. A centrifugal pump comprising:

a housing having a housing cavity, an inlet, and an outlet;

a shaft located in the housing cavity;

a radial bearing coaxially surrounding said shaft, the shaft and the radial bearing being rotatable with respect to one another;

an impeller positioned to receive a fluid from the inlet and to exhaust a fluid to the outlet, the impeller having an impeller hub with an opening therein, the impeller including an impeller recess for receiving the radial bearing;

a thrust balancing valve associated with the impeller hub to define a variable orifice for fluidic communication with the inlet;

a wall for containing the fluid, the wall having an interior surface with different elevations for inhibiting rotational flow and reducing angular velocity of the fluid, the interior surface disposed adjacent to a rear portion of the impeller.

2. The pump according to claim 1 wherein the impeller has a front side and a back side; and further comprising a first wear ring assembly associated with the front side and a second wear ring assembly associated with the back side, the second wear ring assembly providing a fixed orifice that remains uniform in opening size regardless of an axial position of the impeller, the variable orifice varying in opening size with the axial position of the impeller.

3. The pump according to claim 2 wherein a balancing chamber is defined by a volume between the second wear ring and the thrust balancing valve, the interior surface cooperating with the impeller to provide a first static pressure to the thrust balancing valve that is approximately equal to or approaches a second static pressure at the fixed orifice within the balancing chamber.

4. The pump according to claim 1 wherein the interior surface comprises a plurality of ribs of higher elevation extending axially from a lower elevation of the interior surface.

5. The pump according to claim 1 wherein the interior surface comprises a plurality of curved elevations being curved within a plane of the interior surface, the curved elevations extending axially frontward from a lower elevation of the interior surface.

6. The pump according to claim 1 wherein the interior surface comprises ribs, each rib having a cross-sectional contour that generally tracks an impeller cross-sectional contour of a rear portion of the impeller to maintain a minimum axial rib clearance between the ribs and the rear portion.

7. The pump according to claim 6 wherein each rib has a rib height protruding axially from a lower elevation of the interior surface, the rib height approximately equaling a total axial clearance between the rear portion and the lower elevation to maximize a first static pressure presented to the thrust balancing valve by approaching or equaling a second static pressure at a periphery of the impeller or at the outlet.

8. The pump according to claim 1 wherein the different elevations include a lower elevation and a higher elevation defined by stationary vanes, the stationary vanes being generally rectilinear strips spaced apart by angular intervals within a range from approximately one-hundred eighty degrees to approximately eighteen degrees.

9. The pump according to claim 1 wherein the interior surface includes generally stationary vanes having a cross-sectional contour with a generally linear portion and an arcuate portion tracking a curved cross-sectional profile of a rear portion of the impeller to maintain a generally uniform minimum axial rib clearance dimension between the stationary vanes and the rear portion.

10. The pump according to claim 1 further comprising a wear ring mounted on the impeller, a volume between the wear ring and the impeller forming a balancing chamber, the interior surface cooperating with the impeller to provide a generally uniform static pressure within the balancing chamber versus an internal radius of the pump relative to a shaft axis of the pump.

11. The pump according to claim 1 further comprising:

a first inner ring associated with a front side of the impeller, the first inner ring bounding a first generally circular area;

a second inner ring associated with back side of the impeller, the second inner ring bounding a second generally circular area, the first generally circular area being less than or equal to seventy percent of the second generally circular area to promote a balancing force for balancing net axial forces acting upon the impeller during operation of the pump.

12. The pump according to claim 1 wherein the interior surface comprises at least one higher elevation axially extending above a lower elevation, the pump interior surface reducing an average angular velocity of the pumped fluid to less than one-half of the angular velocity of the impeller to increase the static pressure at the thrust balancing valve.

13. A magnetic-drive centrifugal pump comprising:

a housing having a housing cavity, an inlet, and an outlet;

a shaft located in the housing cavity;

a radial bearing coaxially surrounding said shaft, the shaft and the radial bearing being rotatable with respect to one another;

an impeller positioned to receive a fluid from the inlet and to exhaust a fluid to the outlet, the impeller having an impeller hub with an opening therein, the impeller including an impeller recess for receiving the radial bearing;

a thrust balancing valve associated with the impeller hub to define a variable orifice;

a first magnet assembly associated with the impeller such that the first magnet assembly and the impeller rotate simultaneously;

a second magnet assembly coaxially oriented with respect to the first magnet assembly, the second magnet assembly permitting coupling to a drive shaft;

a containment member oriented between the first magnet assembly and the second magnet assembly, the containment member includes a plurality of radial ribs extending axially from a rear interior surface of the containment member.

14. The magnetic-drive pump according to claim 13 wherein the containment member includes a flange having a front interior surface which is generally parallel to the rear interior surface, a second plurality of radial ribs extending axially from the front interior surface.

15. The magnetic-drive pump according to claim 14 further comprising a wear ring assembly located adjacent and frontward from the second plurality of radial ribs.

16. The magnetic-drive pump according to claim 13 wherein the impeller has a front side and a back side; and further comprising a first wear ring assembly associated with the front side and a second wear ring assembly associated with the back side, the second wear ring assembly providing a fixed orifice that remains uniform in opening size regardless of an axial position of the impeller, the variable orifice varying in opening size with the axial position of the impeller.

17. The magnetic-drive pump according to claim 13 wherein the ribs comprise elevated generally rectilinear strips spaced apart by angular sectors.

18. The magnetic-drive pump according to claim 13 wherein the ribs comprise a plurality of curved elevations spaced apart by generally uniform angles.

19. The magnetic-drive pump according to claim 13 wherein the ribs comprise stationary vanes on a rear surface of the containment member.

20. The magnetic-drive pump according to claim 13 wherein each rib has a cross-sectional contour that generally tracks a cross-sectional contour of a rear portion of the impeller to maintain a substantially minimum axial rib clearance between the ribs and the rear portion of the impeller.

21. The magnetic-drive pump according to claim 20 wherein each rib has a rib height protruding axially from the rear interior surface, the rib height approximately equaling a total axial clearance between the rear portion and the rear interior surface to maximize a first static pressure presented to the thrust balancing valve to approach or equal a second static pressure at a periphery of the impeller or at the outlet.

22. The magnetic-drive pump according to claim 13 wherein the ribs are spaced by generally uniform angular intervals within a range from approximately one-hundred eighty degrees to approximately eighteen degrees.

23. The magnetic-drive pump according to claim 13 wherein the ribs comprise radially extending stationary vanes having a rib cross-sectional contour tracking an impeller cross-sectional profile of a rear portion of the impeller to maintain a substantially minimum axial rib clearance dimension between the ribs and rear portion.

24. The magnetic-drive pump according to claim 13 wherein the ribs, a rear portion of the impeller, and the rear interior surface of the containment member cooperate to provide a generally uniform static pressure within the containment member versus an internal radial dimension relative to a shaft axis of the magnetic-drive pump.

25. The magnetic-drive pump according to claim 13 further comprising a fixed orifice having a fixed opening size regardless of an axial position of the impeller, a balancing chamber formed between the fixed orifice and the thrust balancing valve, wherein the ribs, the impeller rear, and the rear surface of the containment member cooperate to provide a first static pressure to the balancing valve that is equal to or approaches a second static pressure at the fixed orifice within the balancing chamber.

26. The magnetic-drive pump according to claim 13 further comprising:

a first inner ring associated with a front side of the impeller, the first inner ring bounding a first generally circular area;

a second inner ring associated with back side of the impeller, the second inner ring bounding a second generally circular area, the first generally circular area being less than or equal to seventy percent of the second generally circular area to promote a balancing force for balancing net axial forces acting upon the impeller during operation of the magnetic-drive pump.

27. The magnetic-drive pump according to claim 13 wherein the ribs axially extend from the rear interior surface, the ribs and the rear interior surface cooperating with the impeller to facilitate a reduction in an average angular velocity of the pumped fluid to less than one-half of the angular velocity of the impeller to increase the static pressure at the thrust balancing valve.

* * * * *